US009212860B2

(12) United States Patent
Kunau

(10) Patent No.: US 9,212,860 B2
(45) Date of Patent: Dec. 15, 2015

(54) FIREARM RIFLING

(71) Applicant: Daniel Kunau, Boone, CO (US)

(72) Inventor: Daniel Kunau, Boone, CO (US)

( * ) Notice: Subject to any disclaimer, the term of this patent is extended or adjusted under 35 U.S.C. 154(b) by 0 days.

(21) Appl. No.: 14/194,662

(22) Filed: Feb. 28, 2014

(65) Prior Publication Data

US 2015/0007479 A1 Jan. 8, 2015

Related U.S. Application Data

(60) Provisional application No. 61/851,012, filed on Feb. 28, 2013.

(51) Int. Cl.
*F41A 21/18* (2006.01)
*F41A 99/00* (2006.01)

(52) U.S. Cl.
CPC ..... *F41A 21/18* (2013.01); *F41A 99/00* (2013.01)

(58) Field of Classification Search
CPC ..... F41A 21/18; F41A 99/00; F41A 21/02; F41A 21/12; F42B 10/24; F42B 10/26
USPC ..... 42/78
See application file for complete search history.

(56) References Cited

U.S. PATENT DOCUMENTS

| | | | | |
|---|---|---|---|---|
| 835,482 | A * | 11/1906 | Vulpius | 42/78 |
| 840,085 | A * | 1/1907 | Mulock | 42/78 |
| 3,616,562 | A | 11/1971 | Burgsmüller | |
| 3,643,364 | A * | 2/1972 | Koch | 42/78 |
| 3,780,465 | A * | 12/1973 | Polcha | 148/565 |
| 4,308,681 | A | 1/1982 | Gorman | |
| 5,077,926 | A | 1/1992 | Krumm | |
| 6,427,373 | B1 | 8/2002 | Schuemann | |
| 7,802,394 | B1 | 9/2010 | Bartoli | |
| 8,635,797 | B2 | 1/2014 | Cha et al. | |
| 2012/0131836 | A1 | 5/2012 | Findlay | |
| 2012/0180362 | A1 * | 7/2012 | Feddersen | 42/78 |
| 2013/0239451 | A1 * | 9/2013 | Glock | 42/78 |
| 2014/0150320 | A1 * | 6/2014 | Feddersen | 42/78 |

FOREIGN PATENT DOCUMENTS

| | | | |
|---|---|---|---|
| DE | 102012000686 | A1 | 7/2013 |
| WO | WO2013074132 | A1 | 5/2013 |

* cited by examiner

*Primary Examiner* — Troy Chambers
*Assistant Examiner* — Bridget Cochran
(74) *Attorney, Agent, or Firm* — Brevetto Law Group

(57) ABSTRACT

An improve firearm rifling is provided in which the trailing edge face of the land is significantly longer than the rifling land top surface. The trailing edge angle between the trailing edge face and the level of the groove floor surface is a much smaller angle than conventional rifling land trailing edge angle, while the leading edge angle of the disclosed embodiments may be akin to a conventional rifling leading edge angle. Due to this, the present embodiments provide a rifling land profile that is nonsymmetrical, with the trailing edge face being at a much lower angle than the leading edge face which is configured in a more upright orientation.

19 Claims, 7 Drawing Sheets

200

FIREARM RIFLING

CROSS-REFERENCE TO RELATED APPLICATIONS

The present application claims priority from, and incorporates by reference in its entirety, U.S. provisional patent application 61/851,012.

BACKGROUND

1. Field of the Invention

The present invention relates to firearms, and more specifically to the rifling in the barrel of a firearm.

2. Description of Related Art

Gun barrels are typically made from a solid piece of steel or other metal. Traditionally, a center hole is cut through the center of a barrel using a specialized drill or other machine. The size of the initial hole is typically slightly smaller than the caliber of the gun barrel. Then grooves twisting around the inside of the barrel are formed to create a rifling pattern. The rifling pattern on the inside of the barrel imparts spin on the bullet or other projectile being fired. The rifling spins the projectile about its long axis, thus stabilizing the flight of the bullet and improving its aerodynamic stability and accuracy. The rifling is provided on inside of the barrel as equally spaced lands separated by grooves along the barrel circumference. Conventional rifle barrels typically have several lands which are separated by grooves within the rifle barrel. The grooves are made by cutting material out from the inside of the barrel, leaving a land (ridge) between each pair of grooves. The grooves are machined around the inside of the barrel in spiral twist pattern. The lands are designed to maintain contact with the sides of the bullet as it is projected down the barrel, thus imparting a spin on the bullet as it leaves the muzzle of the rifle.

FIGS. 1A and 1B depict two types of conventional rifling. The most common type of conventional rifling, as shown in view 100 of FIG. 1A, consists of lands and grooves with relatively sharp edges that bite into the surface of the bullet. View 120 shows further detail on land 106. The land top 106 and land sides 104 and 108 are sometimes at nearly right angles to each other, as depicted in view 100. In other conventional embodiments, as depicted in view 120, the land top 106 may be at an angle with the sides 112 and 114 greater than a right angle. In any event, the sides of the lands in conventional implementations are Recently, however, a newer type of polygonal rifling has been used in handguns. Polygonal rifling is characterized by lands with a more rounded, curvilinear polygon shaped profile. Proponents of polygonal rifling point to the higher muzzle velocities and greater accuracy achievable with polygonal rifling. Moreover, barrels with polygonal rifling tend to last longer than barrels with conventional sharp edged rifling due to the reduced friction between the bullet and the rifle barrel.

Rifling is characterized by a twist rate which affect the rate of spin imparted to a bullet. The twist rate is defined as the distance a rifling land takes to complete one full revolution within the barrel. Twist rates vary based on the size, shape and weight of the projectile being fired. A shorter distance twist provides a faster twist, producing a higher spin rate on the projectile. A twist rate of 1 turn in 8 inches (1:8 inches) is faster than a 1:12 inch twist rate. In general, longer twist rate barrels are used with larger diameter, shorter bullets (e.g., spherical lead balls) while relatively longer, small diameter bullets are typically fired through shorter (faster) twist rate barrels. For example, a large diameter muzzle-loading rifle that shoots spherical lead balls might have a low twist rate of 1:48 inches, that is, 1 turn in 48 inches. At the other extreme, pistols—e.g., 9 mm, .357 and .40 caliber—often have a twist rate of approximately 1:10 inches.

In regards to caliber, it should be noted that for a given caliber there are often several different types of rifle, each of which has different rifling characteristics. For example, rifles in the 30 caliber family include .30-06 Springfield, .30-30 Winchester, 308 Norma, 308 Winchester, 300 Winchester Mag, and others. All of these rifles shoot 30 caliber bullets (0.308 inch diameter bullets) and are 30 caliber as measured from the top of one land to the top of the land on the opposite side of the bore. The "08" in a 308 Winchester means that each land has a four thousandths of an inch groove next to it (two grooves of four thousandths of an inch give us the "08"). In this way, the rifling characteristics tend to be somewhat different in each different type of 30 caliber weapon. For example, the number of the grooves or the groove profile or land shape often differs from one model of weapon to the next.

SUMMARY

Embodiments disclosed herein address the above stated needs by providing rifle barrel apparatus and methods of providing the same. A gun barrel is provided with a bore traversing the length of the barrel. The bore has a number of lands, each of the lands having a predefined height and a land top surface. The bore is also provided with a number of grooves on the surface of the bore. Each sequential pair of the grooves is separated by one of the lands. Each of the lands has a trailing edge face characterized by a land top to trailing edge ratio of no greater than 1:8.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. In the drawings.

DETAILED DESCRIPTION

Figure 1A:
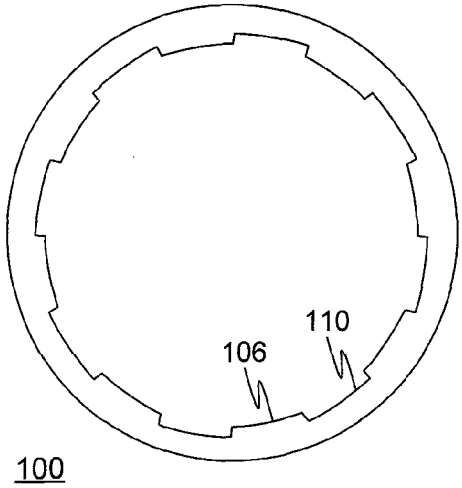
FIG. 1A PRIOR ART
FIGS. 1A and 1B depict two types of conventional rifling.
Figure 1B:
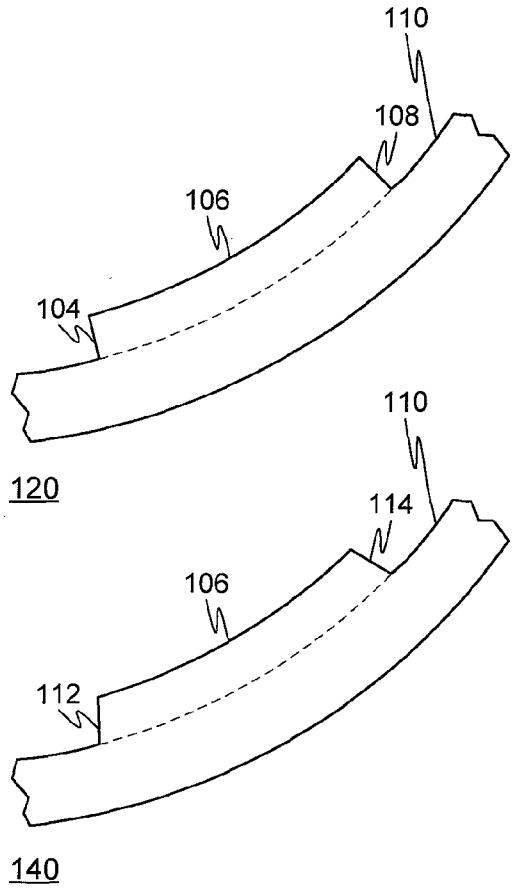
FIG. 1B PRIOR ART
Figure 1B:
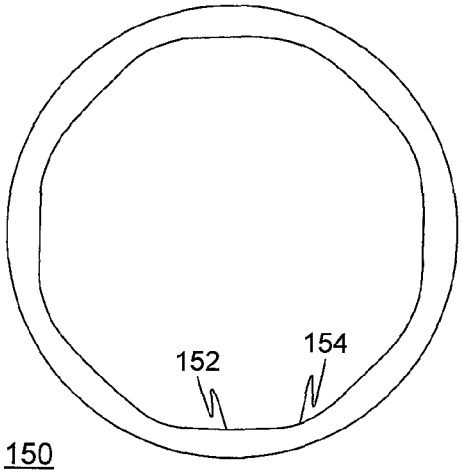
FIG. 1B PRIOR ART
Figure 2:
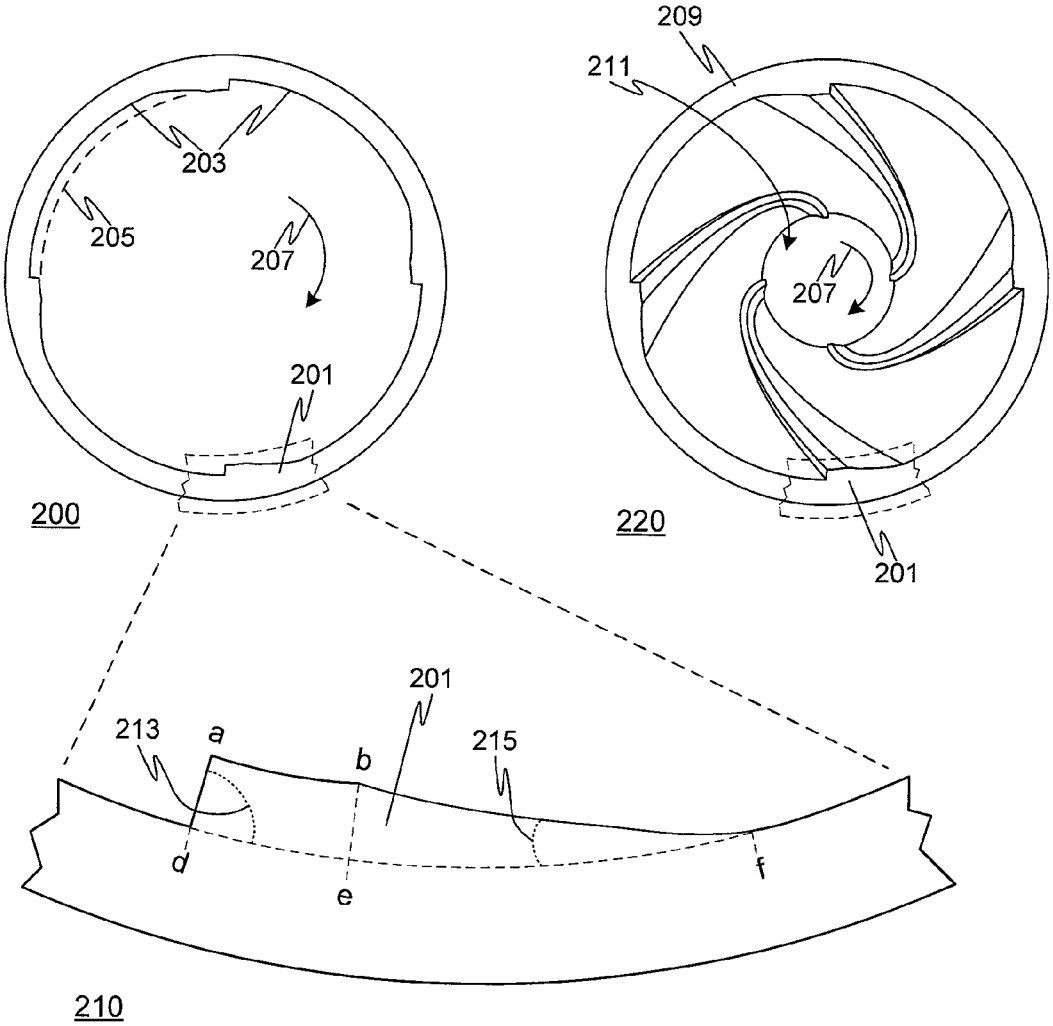
FIG. 2 depicts the rifling of a firearm barrel according to various embodiments of the invention.

FIG. 2 depicts aspects of rifling according to various embodiments of the present invention. View 200 of FIG. 2 is a cross-section of a firearm barrel depicting the rifling according to various embodiments of the invention. For the purposes of illustration and ease of explaining the various embodiments the rifling shown in the figures is not necessarily to scale. For example, the rifling in an actual gun barrel may not be cut as deep with respect to the barrel as that shown in the figures.

The present inventor noticed that conventional firearm rifling does not allow the rifling lands to fully engage into the surface of the projectile. For example, conventional rifling lands to not cut into the bullet jacket to the depth needed to provide a complete seal between the bullet and the inner surface of the barrel. The bullet may deform somewhat, in particular the rear portion of the bullet, outward towards the wall of the barrel. However, conventional rifling provides only a partial seal, allowing a portion of the expanding gunpowder gasses to escape past the projectile. This, in turn, reduces the potential speed of the projectile can reach for a given explosive charge within the barrel behind the projectile. This friction is often more apparent in the latest ammunition. Lately, there is a trend to reduce or eliminate lead bullets. As a result more bullets are being sold with copper jackets, since copper deforms relatively well as compared to other metals that are sufficiently heavy for the purpose of bullets. However, copper is not nearly as malleable as lead, and therefore does not deform as readily. This results in increased friction of copper clad bullets within the barrel. To compensate for the lower muzzle velocities due to the increased friction, some manufacturers have increased the gun powder charge of their shells. The sum result is that barrels, many of which were originally intended to shoot lead bullets, tend to wear out faster when projectiles clad in copper or other metals are shot from them.

A gun barrel may be formed from a solid piece of metal or other material by drilling or machining a center hole lengthwise through the material. The hole is straight and has relatively smooth sides before the rifling grooves are cut into the barrel. For example, before the rifling is formed, the hole is slightly smaller than the size of the firearm's caliber. The hole drilled is generally smaller than the caliber by enough material to accommodate the lands, as indicated by the dashed line 205. (In practice the initial hole may be even slightly smaller than the top of the lands, leaving excess material to be machined away during the later steps of forming the inside surface of the barrel.) Grooves are cut or otherwise machine on the inner surface of the barrel to form the rifling pattern of the barrel. For example, the firearm barrel cross-section of FIG. 2A view 200 depicts grooves 203. The bore hole traverses the length of the barrel, in some instances, with a slightly enlarged area at the breech end to accept the insertion of a shell or other projectile. The material left between the grooves are called lands. The caliber is generally defined by the diameter of the rifle bore as measured from the top of lands on opposite sides of the bore. The diameter between the bottoms of opposite grooves is approximately the same as the diameter of the bullet or other projectile to be fired in the weapon. (In practice the bullet or other projectile may be slightly smaller than the diameter of the hole defined by the bottom of the grooves.) The size of the initial hole (plus excess material cut away in later steps) defines the top surface of the lands. Since the lands protrude up from the grooves, the lands cut into the projectile, allowing the twist of the lands to impart spin on the projectile as it passes down the barrel bore. Each sequential pair of the lands—that is, each two consecutive lands—are separated by one of the grooves. Hence, the number of grooves in any particular barrel always equals the number of grooves.

Several other methods of creating rifle barrels and rifling may be used in conjunction with the various embodiments. In one such method, button rifling, the grooves are pressed into the inner surface of the barrel by forcing a button tool down the barrel. Hammer forged barrels are created by forging the barrel over a mandrel containing a reverse image of the rifling. Rifling may also be created by flow forming the barrel preform over a mandrel containing a reverse image of the rifling. These, or other methods of manufacturing, may be used to form a rifling profile in accordance with the various embodiments.

The lands and grooves are formed with an extended spiral twist about the longitudinal axis of the barrel. The cross-sectional view 200 of figure FIG. 2 is looking in the direction the projectile travels along the barrel, that is, in the direction from the chamber end of the barrel (where the barrel attached to the receiver or frame) towards the breech end of the barrel. The spiral twists of the lands 201 and grooves 203 may be more readily seen in view 220. The embodiment depicted in FIG. 2 has a right twist 207. A projectile travelling down the barrel from chamber end 209 of the barrel towards the breech end 211 of the barrel is imparted with a right twist 207, causing the projectile to have a counter-clockwise rotation upon exiting the breech end 211 of the barrel (as view from the shooter's perspective, behind the projectile).

Views 200 and 220 of FIG. 2 show a barrel cross-section with four grooves 203 and four lands 201. Various embodiments disclosed herein tend to have fewer land/groove pairs than firearm barrels with conventional rifling. In practice a firearm barrel rifled in accordance with the embodiments disclosed herein may have more, or fewer, land/groove pairs than the four depicted in FIG. 2. A barrel rifled in accordance with the present invention could have as few as two land/groove pairs—that is, two lands and two grooves. In embodiments with only two groove/land pairs the lands are taller than embodiments with four or more land. For example, for a conventional caliber in which the lands tend to be around four thousandths of an inch high (e.g., .308 caliber), an embodiment disclosed herein which only two groove/land pairs would typically be from five to eight thousandths of an inch high. Conventional firearm barrels often have six or eight lands, but in theory could have as few as three, but not fewer than three. At the other extreme, a firearm barrel according to the various embodiments disclosed herein could be formed with a hundred or more lands, depending upon the size of the barrel, hardness and shape of the projectile and specifics of the implementation.

View 210 of FIG. 2 depicts a cutaway view of one land 201 of the rifling depicted in views 200 and 220. The land has a top surface a-b, as shown in view 210 of FIG. 2. The land top surface a-b is defined by the initial hole drilled in the barrel blank used in making the barrel. The land top surface a-b may be somewhat concave in shape, roughly conforming to the shape of the initial drilled hole, for example, the shape of dotted line 205. The land also has two edges defining the sides of the land. The relatively steep edge a-d is the leading edge of the land. The corner "a" formed by leading edge a-d and land top a-b tends to bite into the bullet or other projectile as it is propelled down the barrel. The leading edge a-d is not significantly different from the leading edge of conventional rifling. The corner "a" of land 201—that is, the left side of land top a-b—tends to be relatively sharp in most implementations in order to bite into the bullet or other projectile. Of course, in practice the corner "a" may not be a perfectly sharp edge. In a gun barrel the corners of the lands tend to wear out over time. Therefore the corner "a" may, in fact, be finely chamfered so as to wear more evenly as the material of the barrel is worn away by repeated shooting. Such a chamfer may be so small to be practically negligible with respect to the dimensions of the land 201.

The leading edge angle 213 of leading edge face a-d is defined at the corner where leading edge face a-d of the land meets groove 203. Leading edge face a-d may be substantially vertical. By "substantially vertical" it is meant that the leading edge angle 213 is 90 degrees+/−five degrees. In various embodiments the leading edge face a-d may be sloped to some extent. In an embodiment with a sloped leading edge face a-d, a typical value of leading edge angle 213 may be fifteen degrees less than a right angle, i.e., seventy-five degrees. In other embodiments the leading edge angle 213 may be more upright, or sloped to a greater extent, taking on any value from substantially vertical to as little as 45 degrees. Some implementation may have a leading edge angle 213 that is actually greater than ninety degrees. In such implementations care must be taken in the type of material used as a projectile. Lead or other relatively soft projectile materials may tend to become lodged next to the leading edge a-d in those implementations with a leading edge angle 213 greater than ninety degrees.

Turning to the trailing edge angle 215 at point f, it is noted that this angle is considerably less than conventional rifling designs. The trailing edge angle 215 according to various embodiments may be as little as one degree or at great as thirty-five degrees, or any value or range between one and thirty-five degrees. A typical value for trailing edge angle 215 is ten degrees, plus or minus 2 degrees. Another typical value for trailing edge angle 215 is fifteen degrees, plus or minus 2 degrees. Another typical value for trailing edge angle 215 is twenty degrees, plus or minus 3 degrees. The various embodiments may utilize many other values of trailing edge angle 215 and ranges within the constraints of a minimum value of one degree or at great as thirty-five degrees, or any value or range between one and thirty-five degrees.

In various embodiments the trailing edge face b-f maybe be configured slightly concave as depicted in view 210 of FIG. 2 rather than being perfectly flat. The dotted line d-e-f is also rounded, being an extension between the grooves on either side of land 201 in view 210. Due to the curve in dotted line d-e-f and the concave shape in some embodiments of trailing edge face b-f, it can be difficult to accurately measure the trailing edge angle 215. Therefore, the trailing edge angle 215 is defined at the angle taken as if the side e-f and the trailing edge face b-f were flattened into straight surfaces, assuming that the line b-e is at a right angle at the point "e" to the line e-f. For example, if the trailing edge face b-f is 1 mm long, the line e-f is 0.9848 mm long, and b-e is at a right angle to e-f, then the trailing edge angle 215 (angle b-f-e) is 10 degrees. Or to take another example, if the trailing edge face b-f is 1 mm long, the line e-f is 0.9659 m long, and b-e is at a right angle to e-f, then the trailing edge angle 215 is 15 degrees. This method of provides a bright line rule for calculating the trailing edge angle 215.

For ease of illustration, land top surface a-b in view 210 is shown to be relatively longer than it typically is, in relation to trailing edge face b-f. This ratio is called the land top to trailing edge ratio. The land top to trailing edge ratio—often expressed as a percentage—is the top surface a-b taken as a ratio (or percentage) the length of trailing edge face b-f. As with the trailing edge angle 215, distances a-b and b-f are actually the distances taken along the surface (in the event the surfaces are not flat), rather than the distance between the two points. In many embodiments land top surface a-b is approximately 3:100 (3%) to 1:20 (5%) the length of trailing edge face b-f. In one embodiment, land top surface a-b has no width at all—that is, trailing edge face b-f connects directly to the top of leading edge a-d, creating a point (rather than a flat or concave land top surface a-b). At the other extreme, land top surface a-b may be as much as 4:10 (40%) the length of length of trailing edge face b-f. In various embodiments, the land top surface a-b may be as little as 0% up to and including 4:10 (40%) the length of trailing edge face b-f, or any percentage or range between 0% up to and including 4:10 (40%) the length of trailing edge face b-f. For example, in some embodiments the land top to trailing edge ratio may be from 3:100 to 1:20 (3% to 5%). In other embodiments the land top to trailing edge ratio may be from 1:50 to 1:16 (2% to 6.25%). In yet other embodiments the land top to trailing edge ratio may be less than or equal too 1:10 (10%), less than or equal to 1:16 (6.25%), less than or equal to 1:20 (5%), or less than or equal to 1:25 (4%), or other such ranges or ratios as are known to those of ordinary skill in the art. A land top to trailing edge ratio of no greater than 1:8 includes the 1:8 ratio (12.5%), the 1:9 ratio (11.1%), the 1:50 ratio (2%); and all ratios associated with percentages smaller than 12.5% (1:8 ratio). It should be that the width may vary in certain types of weapons. For example, in extreme cases, such as the case with in air rifles, the trailing edge b-f may be adjacent the leading edge of the next land. In other embodiments the land width may be approximately the same as the groove width.

Figure 3A:
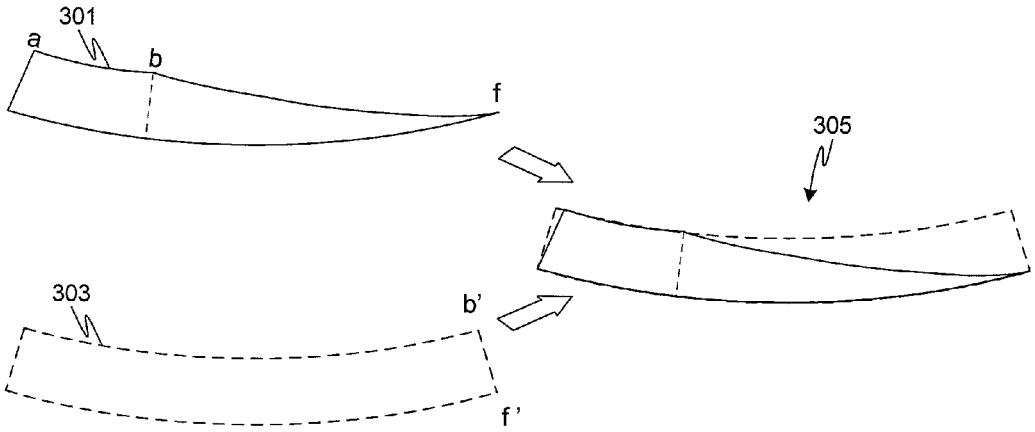
FIGS. 3A and 3B depict embodiments of the present novel rifling land taken in comparison with a conventional rifling land.
Figure 3B:
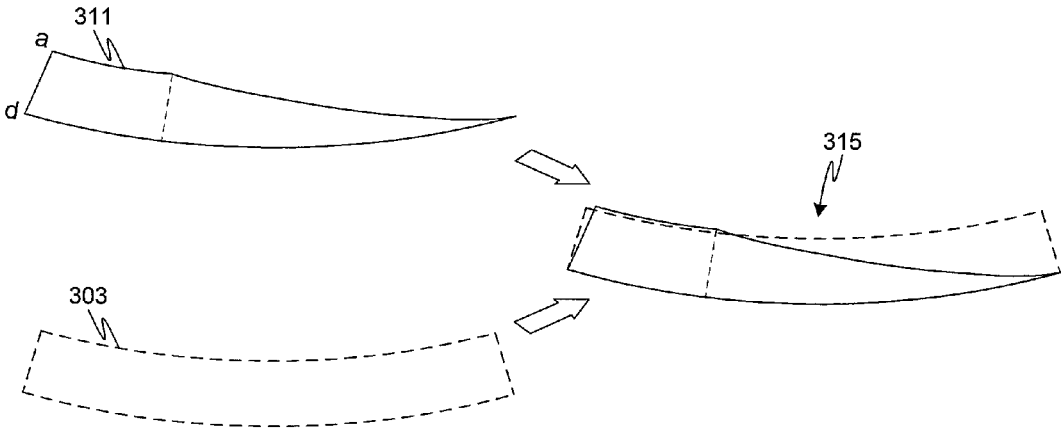

FIGS. 3A and 3B depict embodiments of the present novel rifling land taken in comparison with a conventional rifling land. Rifling land 301 of FIG. 3A is configured in accordance with various embodiments disclosed herein. Rifling land 303 of FIG. 3A is a conventional rifling land. In view 305 the rifling land 301 is overlapped with conventional rifling land 303 to illustrate the differences between the two configurations. A vast difference can be seen between the trailing edge face b-f of novel rifling land 301 as compared to trailing edge face b'-f' of conventional rifling land 303. The trailing edge face b'-f' of conventional rifling land 303 is symmetrical with its leading edge face. By contrast, in rifling land 301 in accordance with various embodiments disclosed herein, the trailing edge face b-f is significantly longer than leading edge face a-d.

Turning to FIG. 3B, in one embodiment the land 311 may be configured slightly taller than conventional rifling lands of the same caliber. A rifle land according to various embodiments may be of any conventional land height for a given caliber of bullet. The height of a land is measured from the level of the adjacent groove to the level of the land top surface in a line passing through the center of the bore. In other words the land height is the distance from the bore center to a groove minus the distance from the bore center to the top surface of the adjacent land. Typically, the land height tends to be from three to four thousands of an inch for bullets from 17 caliber to 45 caliber. Some types of cartridges have land heights of as much as eight thousandths. Since the various embodiments disclosed herein have land profile with less area, the land heights of the present embodiments may be taller than conventional land heights. This can be seen in view 315 of FIG. 3B by comparing the height of leading edge face a-d with the height of conventional rifling land 303 indicated by the dotted line. The novel rifling land 311 may be taller by virtue of a smaller land profile area. Thus, even though the rifling land 311 is slightly taller than conventional land 303, the novel land 311 of the FIG. 3B embodiment deforms the bullet or other projectile less than the conventional land 303. In this embodiment the rifling land 311 may be from 1% to 20% taller than a conventional land 303 of the same caliber. In one embodiment the land height is 10% taller than conventional rifling land heights.

Figure 4:
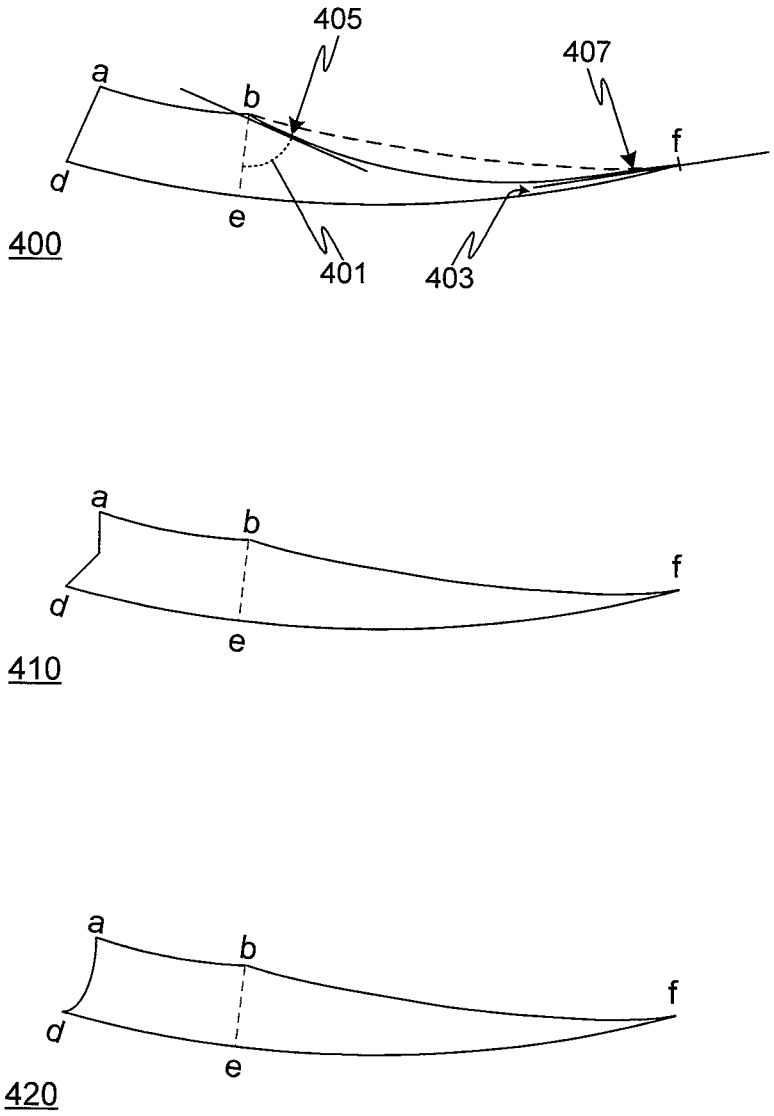
FIG. 4 depicts three embodiments of a rifling land according to the present invention.

FIG. 4 depicts three embodiments of a rifling land according to the present invention. View 400 depicts a land with a steeper trailing edge face b-f than those shown in FIGS. 2 and 3. The trailing edge face b-f of view 400 is shown by the solid line between points "b" and "f". For comparison purposes, the trailing edge face b-f of the previous embodiments is depicted with a dotted line. The curve of the trailing edge face b-f is defined by the upper trailing edge angle 401 measured at a point 405 which is 90% of the way towards "b" from point "f" and the lower trailing edge angle 403 measured at a point 407 which is 90% of the way towards "f" from point "b". The angle measurements, measured 10% of the distance away from the top and bottom endpoints of the trailing edge face, are able to more precisely define the curve of the trailing edge face than measurements taken directly at the endpoints themselves. The line b-e from which the upper trailing edge angle 401 measurement is made is a line bisecting the center of the barrel bore and the point "b" which is the point between the upper trailing edge face b-f and the rifling land top surface a-b. The lower trailing edge angle 403 is measured from the line intersecting the circle defining the bore diameter at point "f" (that is, the line orthogonal to the line intersecting "f" and the center of the barrel bore). The upper trailing edge angle 401 can be as much as 90 degrees or as little as little as 30 degrees, or any value or range between or including these two extremes. In a typical implementation of the present embodiments the upper trailing edge angle 401 may be 60 degrees, 62 degrees, 64 degrees, 66 degrees, 68 degrees, 70 degrees, 72 degrees, 74 degrees, 76 degrees, 78 degrees, 80 degrees, or any counting number of degrees between 50 and 90 degrees. In other embodiments the upper trailing edge angle 401 is 70 degrees+/−five degrees. In another embodiment the upper trailing edge angle 401 is 60 degrees+/−five degrees. The lower trailing edge 403 angle can be as much as 30 degrees or as little as little as 0.10 degree, or any value or range between or including these two extremes. In a typical implementations of the present embodiments the lower trailing edge 403 may be 2 degrees, 3 degrees, 4 degrees, 5 degrees, 6 degrees, 7 degrees, 8 degrees, 9 degrees, 10 degrees, 11 degrees, 12 degrees, or any counting number of degrees up to 30 degrees. In other embodiments the lower trailing edge 403 is 8 degrees+/1 four degrees. In another embodiment the lower trailing edge angle 403 is 5 degrees+/−three degrees.

View 410 of FIG. 4 depicts an embodiment with a novel shaped leading edge face a-d. In the embodiment of view 410 the line leading edge face a-d includes two separate face flat sections that meet between the points "a" and "d". The two face section may meet in the center, or may meet as much as 25% of the way towards "a" or towards "d". The angle depicted in view 410 is 135 degrees. In other embodiments the angle between the two face sections may be as little as 120 degrees up to as much as 180 degrees (flat), or any counting value of degrees between. In one embodiment the flat face sections are angled apart from each other by an angle of from 130 to 140 degrees. In another embodiment the flat face sections are angled within a range from 120 to 150 degrees.

View 420 depicts an embodiment in which leading edge face a-d is defined by a curvilinear surface. The surface may have a curve shaped cross-section of from a portion of a circle to a flattened ellipse with a major axis seven times as great as its minor axis, or a section of an ellipse of any value or any range ellipse between these two extremes.

Figure 5A:
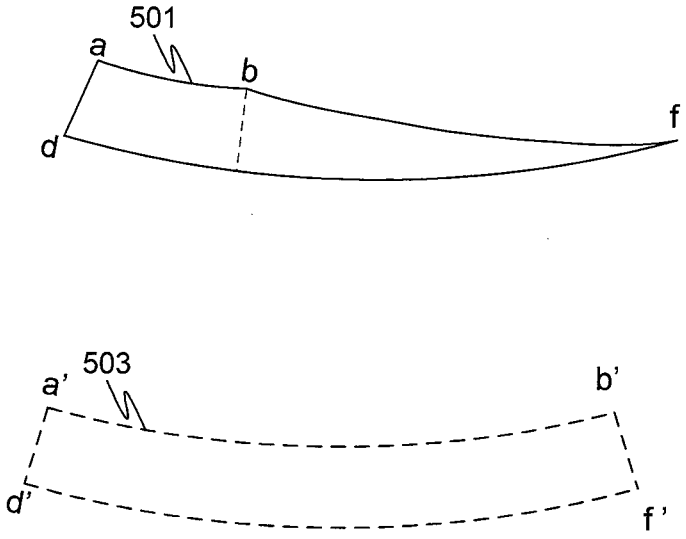
FIG. 5A depicts an embodiment disclosed herein with a smaller land cross-section area than conventional land cross-section.

FIG. 5A depicts an embodiment disclosed herein with a smaller land cross-section area than conventional land cross-section. Land 501 is a rifling land in accordance with the various embodiments. Land 503 is a conventional rifling land, shown for comparison. It can be readily seen that the novel land 501 is characterized by a much smaller cross-section area than the conventional land 503. The flattened land profile area approximation is a method of calculating an approximation of the area of a land cross-section. This method of calculating the cross-section area is valid for comparing the relative areas of the present embodiments in view of conventional rectangular land areas. The flattened land profile area approximates the land area by simply multiplying the land height with the land width, ignoring the slightly rounded top and bottom of the land. For example, a typical conventional rectangular 9 mm land (such as land 503 in the figure) is 0.055 inches wide and 0.0045 inches tall and has a flattened land profile area approximation of 0.0002475 square inches ($2.475\times10^{-4}$ in$^2$). By comparison, the embodiment 501 with a slightly concave trailing edge face has a land profile area approximation approximately 50% smaller than conventional rectangular land 503. For the 501 embodiment the area approximation is 0.0001240 square inches ($1.240\times10^{-4}$ in$^2$). All of the embodiments disclosed herein tend to have a much smaller cross-section area than conventional rectangular lands. Some embodiments have cross-sectional areas of no greater than 50% the area of conventional rectangular lands. Other embodiments have cross-sectional areas of no greater than 25% the area of conventional rectangular lands. Other embodiments have cross-sectional areas of no greater than 30% the area of conventional rectangular lands. Other embodiments have cross-sectional areas of no greater than 35% the area of conventional rectangular lands. Yet other embodiments have cross-sectional areas of no greater than 40% the conventional land area, or no greater than 45% the conventional land area, or no greater than 50% the conventional land area, or no greater than 55% the conventional land area, or no greater than 60% the conventional land area, or no greater than 65% the conventional land area, or no greater than 70% the conventional land area, or no greater than 75% the area of conventional rectangular lands.

Figure 5B:
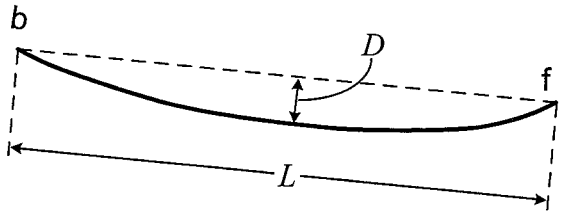
FIG. 5B depicts a method of measure the extend of surface deflection in a concave surface.

FIG. 5B depicts a method of measure the extent of surface deflection in a concave surface. Although the line b-f of FIG. 5B represents the trailing edge face b-f of the embodiment depicted in FIG. 5A, the method of characterizing the extent of surface deflection can be applied to any concave surface, e.g., leading edge face a-d or top surface a-b of FIG. 5A. The extent of surface deflection in a concave surface is defined as the deflection D shown in FIG. 5B taken in view of the diameter length L of the surface. The extent of surface deflection in a concave surface can be written ad D:L, for example 1:10 is a concave surface deflection of 1 unit for a concave surface with a diameter length of 10 units—that is, D=1 and L=10 for a 1:10 concave surface deflection. The trailing edge face b-f of the various embodiments disclosed herein may have from a concave surface deflection of any value up to and including 1:5, for example, 1:100, 1:50; 1:30:1:25, 1:20, 1:15, 1:12, 1:10, 1:9, 1:8, 1:7, 1:6, 1:5, or any value or range from 1:100 to 1:5.

Figure 6:
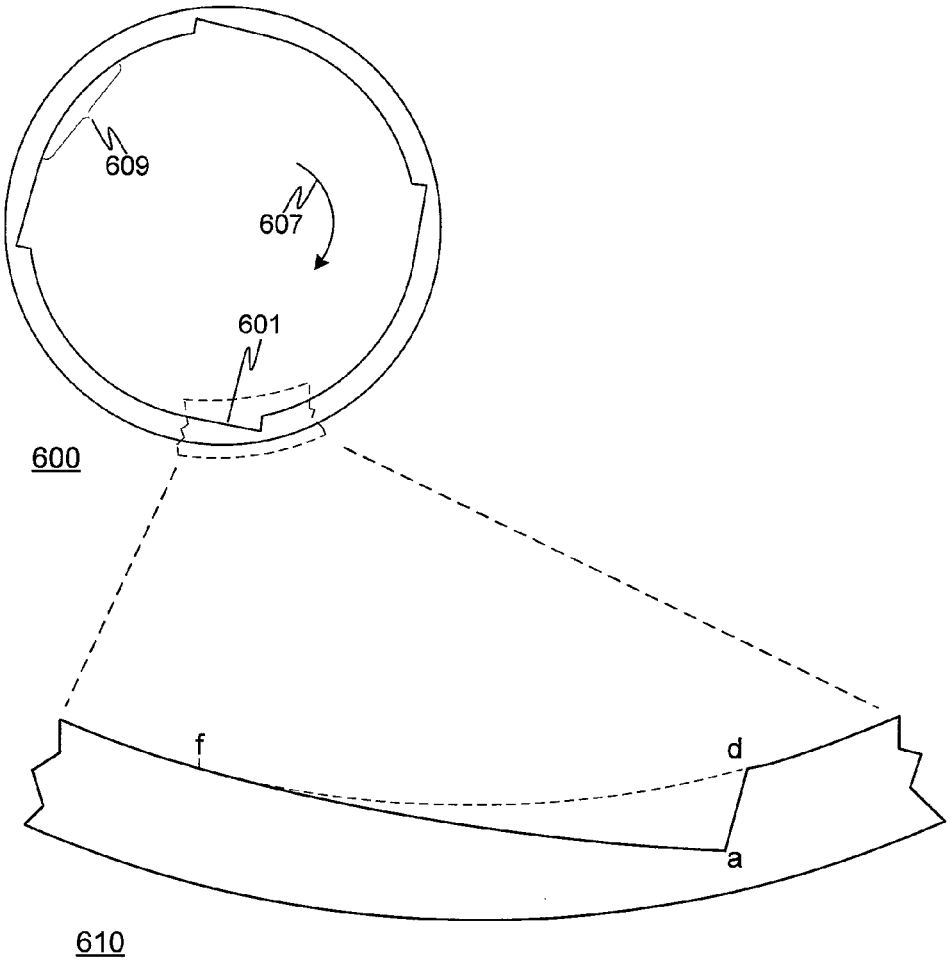
FIG. 6 depicts a rifling land embodiment tailored for hardened spherical projectiles.

FIG. 6 depicts a rifling land embodiment tailored for hardened spherical projectiles. For example, the embodiment 600 of FIG. 6 is suitable for imparting a spin on a BB projectile being fired from a weapon. BBs are particularly difficult to put a spin on due to their hardness and relatively small surface area in contact with the barrel. However, the embodiment depicted in FIG. 6 acts to impart a slight spin on a BB while producing a more dramatic spin on projectiles of the same caliber made of a softer material, e.g., lead. The embodiment 600 features a reverse land—that is, a groove with the approximate shape of a land. The caliber of embodiment 600 is the rounded portion of the barrel between the reverse lands, for example, the inner barrel portion 609 measured against the opposite portion of the barrel on the other side of the bore. The space between the reverse lands tend to guide a BB down the bore, putting a small amount of spin on the BB due mostly to air flow in the reverse lands (shaped grooves). When the same caliber lead pellet is used instead of a BB—e.g., .177 caliber pellets—the apron of the pellet tends to deform and follow the rifling twist of the reverse lands, thus imparting a spin on the lead pellet.

For the purposes of this application the "barrel" refers to the rifled portion of a weapon barrel, and does not include any area at the breech end machined out to accept the insertion of a shell or other projectile. The bore hole traverses the length of the barrel—that is, the bore (or bore hole) passes through the longitudinal length of the rifle barrel. There is typically a number of grooves etched into the surface of the bore hole, leaving lands between the grooves. The lands and grooves are called a rifling pattern.

Figure 7:
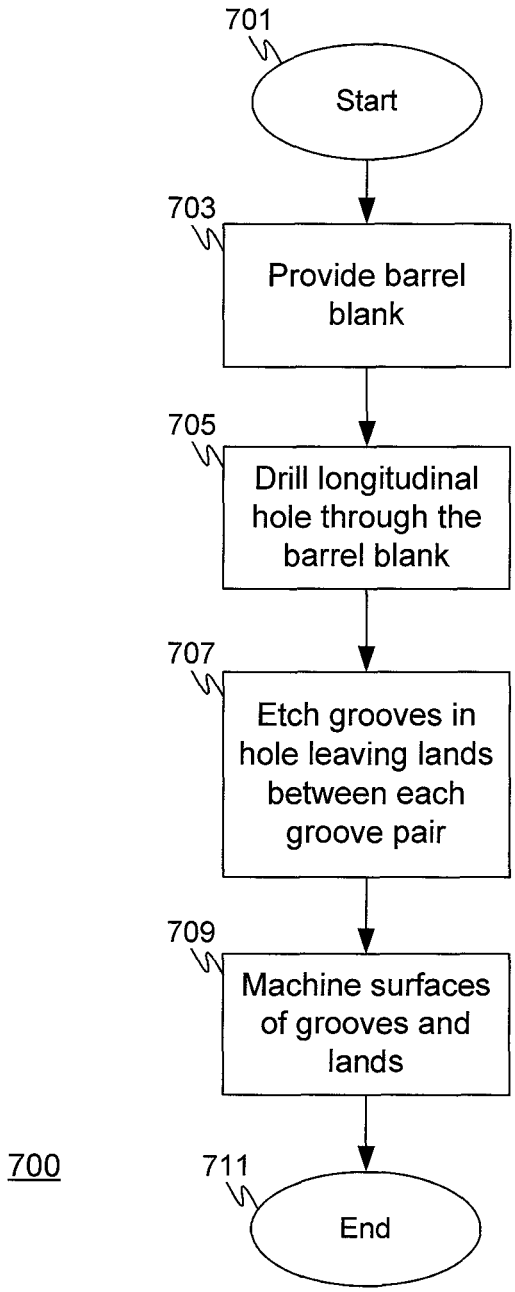
FIG. 7 is a flowchart depicting the creation and use of the novel firearm rifling according to various embodiments of the invention.

FIG. 7 is a flowchart depicting the creation and use of the novel firearm rifling according to various embodiments of the invention. The method begins at 701 and proceeds to 703 where a barrel blank is provided. The size and material of the barrel blank may vary, depending upon the specifics of the shell being fired. Quite often barrel blanks are made of a hardened metal alloy to minimize wear of the rifling due to repeated shooting. In block 705 a longitudinal hole is drilled in the barrel blank, and in 707 grooves are etched in the surface of the bore hole leaving lands between each groove. In block 709 the final machining and shaping of the lands and grooves is performed, leaving a rifling pattern on the surface of the barrel bore. The method ends in step 711.

The description of the various embodiments provided above is illustrative in nature inasmuch as it is not intended to limit the invention, its application, or uses. Thus, variations that do not depart from the intents or purposes of the invention are intended to be encompassed by the various embodiments of the present invention. Such variations are not to be regarded as a departure from the intended scope of the present invention.

What is claimed is:

1. A gun barrel comprising:

a bore traversing the length of the barrel;

a plurality of lands, each of said plurality of lands having a predefined height and a top surface;

a plurality of grooves on the surface of the bore, each sequential pair of said plurality of grooves being separated by one of the plurality of lands; and a trailing edge face on each one of said plurality of lands;

wherein each of the plurality of lands has a land top to trailing edge ratio of no greater than 1:8.

2. The gun barrel of claim 1, wherein the trailing edge face of each of said plurality of lands has a concave shaped surface.

3. The gun barrel of claim 1, wherein the concave shaped surface has a concave surface deflection of at least 1:15.

4. The gun barrel of claim 3, wherein the concave shaped surface has a concave surface deflection of at least 1:10.

5. The gun barrel of claim 3, wherein each of the plurality of lands has a flattened land profile area approximation of no greater than 65% of a conventional flattened rectangular land area.

6. The gun barrel of claim 5, wherein each of the plurality of lands has a flattened land profile area approximation of no greater than 50% of a conventional flattened rectangular land area.

7. The gun barrel of claim 5, wherein the trailing edge face of each of said plurality of lands has a cross-sectional length at least five times larger than the top surface adjacent to the trailing edge.

8. The gun barrel of claim 7, wherein the trailing edge face of each of said plurality of lands has a cross-sectional length at least ten times larger than the top surface adjacent to the trailing edge.

9. The gun barrel of claim 1, wherein the plurality of lands comprises no more than five lands.

10. The gun barrel of claim 1, wherein the plurality of lands comprises no more than four lands.

11. A method of producing a gun barrel comprising:

providing a bore traversing the length of the barrel and having a plurality of lands, each of said plurality of lands having a predefined height and a top surface;

providing a plurality of grooves on the surface of the bore, wherein each sequential pair of said plurality of grooves is separated by one of the plurality of lands; and providing a trailing edge face on each one of said plurality of lands;

wherein each of the plurality of lands has a land top to trailing edge ratio of no greater than 1:8.

12. The method of claim 11, wherein the trailing edge face of each of said plurality of lands has a concave shaped surface.

13. The method of claim 12, wherein the concave shaped surface has a concave surface deflection of at least 1:15.

14. The method of claim 13, wherein each of the plurality of lands has a flattened land profile area approximation of no greater than 50% of a conventional flattened rectangular land area.

15. The method of claim 14, wherein the trailing edge face of each of said plurality of lands has a cross-sectional length at least ten times larger than the top surface adjacent to the trailing edge.

16. The method of claim 15, wherein the plurality of lands comprises no more than four lands.

17. A gun barrel configured to shoot for hardened spherical projectiles, the gun barrel comprising:

a bore traversing the length of the barrel;

a plurality of reverse lands respectively formed from a plurality of grooves, each of said plurality of reverse lands having a predefined groove depth;

a plurality of rounded portions of the barrel, wherein each sequential pair of said plurality of reverse lands is separated by one of the plurality of reverse lands; and a leading groove face and a trailing edge face for each one of said plurality of reverse lands;

wherein each of the plurality of reverse lands has a leading to trailing edge ratio of no greater than 1:8.

18. The gun barrel of claim 17, wherein the caliber of the gun barrel is defined by the distance between opposing pairs of the plurality of rounded portions.

19. The gun barrel of claim 17, wherein air flow in the plurality of reverse lands imparts spin on the hardened spherical projectiles as they travel down the barrel.

* * * * *